US010748514B2

(12) United States Patent
Takehisa

(10) Patent No.: US 10,748,514 B2
(45) Date of Patent: Aug. 18, 2020

(54) MUSICAL INSTRUMENT

(71) Applicant: YAMAHA CORPORATION, Hamamatsu-shi (JP)

(72) Inventor: Hideaki Takehisa, Hamamatsu (JP)

(73) Assignee: YAMAHA CORPORATION, Hamamatsu-Shi (JP)

( * ) Notice: Subject to any disclaimer, the term of this patent is extended or adjusted under 35 U.S.C. 154(b) by 0 days.

(21) Appl. No.: 16/163,862

(22) Filed: Oct. 18, 2018

(65) Prior Publication Data

US 2019/0051271 A1 Feb. 14, 2019

Related U.S. Application Data

(63) Continuation of application No. PCT/JP2017/013934, filed on Apr. 3, 2017.

(30) Foreign Application Priority Data

Apr. 21, 2016 (JP) ..... 2016-085055

(51) Int. Cl.
*G10D 13/06* (2020.01)
*G10H 1/32* (2006.01)
(Continued)

(52) U.S. Cl.
CPC ..... *G10D 13/06* (2013.01); *G10D 13/00* (2013.01); *G10D 13/02* (2013.01); *G10D 13/26* (2020.02);
(Continued)

(58) Field of Classification Search
CPC ..... G10D 13/06; G10D 13/024; G10D 13/00; G10H 3/146; G10H 1/32; G10H 1/053
(Continued)

(56) References Cited

U.S. PATENT DOCUMENTS 4,516,462 A * 5/1985 Schulze ..... G10D 3/146 84/313
5,025,703 A 6/1991 Iba
(Continued)

FOREIGN PATENT DOCUMENTS

EP 1837853 B1 9/2007
JP 2006201334 A 8/2006
(Continued)

OTHER PUBLICATIONS

International Search Report issued in Intl. Appln. No. PCT/JP2017/013934 dated Jun. 13, 2017. English translation provided.
(Continued)

*Primary Examiner* — Jeffrey Donels
(74) *Attorney, Agent, or Firm* — Rossi, Kimms & McDowell LLP

(57) ABSTRACT

A musical instrument includes: a vibrating member configured to be vibrated by a playing operation; an adjusting mechanism configured to perform physical adjustment to change a vibration manner of the vibrating member in playing; a detector configured to detect an adjustment state of the adjusting mechanism; a musical-sound generator configured to generate musical sound based on the playing operation; and a controller configured to control a manner of generation of the musical sound by the musical-sound generator, based on the adjustment state detected by the detector.

8 Claims, 6 Drawing Sheets

(51) Int. Cl.

| | |
|---|---|
| ***G10D 13/00*** | (2020.01) |
| ***G10H 1/053*** | (2006.01) |
| ***G10D 13/02*** | (2020.01) |
| ***G10D 13/10*** | (2020.01) |
| ***G10H 3/14*** | (2006.01) |

(52) U.S. Cl.
CPC ..... *G10H 1/053* (2013.01); *G10H 1/32* (2013.01); *G10H 3/146* (2013.01)

(58) Field of Classification Search
USPC ..... 84/422.1
See application file for complete search history.

(56) References Cited

U.S. PATENT DOCUMENTS 7,294,778 B2 * 11/2007 Susami ..... G10H 3/146 84/411 P
7,468,483 B2 * 12/2008 Yoshino ..... G10H 1/34 84/104
8,546,678 B1 10/2013 Stevens
8,723,014 B2 * 5/2014 Susami ..... G10H 1/348 84/402
8,912,422 B2 * 12/2014 Nakae ..... G10H 1/0551 84/735
9,646,593 B2 * 5/2017 Watanabe ..... G10H 3/146
9,653,059 B2 * 5/2017 Dejima ..... G10H 3/188
9,818,387 B2 * 11/2017 Dejima ..... G10H 3/125
2004/0163529 A1 * 8/2004 Hyakutake ..... G10H 1/342 84/737
2005/0150349 A1 * 7/2005 Susami ..... G10H 3/146 84/299
2006/0156910 A1 * 7/2006 Yoshino ..... G10H 1/34 84/723
2011/0056361 A1 3/2011 Steele
2013/0205978 A1 * 8/2013 Yamabata ..... G10H 1/18 84/616
2018/0130451 A1 * 5/2018 Carnevale ..... G10G 3/04
2018/0247618 A1 * 8/2018 Walker ..... G10D 3/146

FOREIGN PATENT DOCUMENTS

JP 4606182 B2 1/2011
JP 2012150235 A 8/2012
JP 2014206663 A 10/2014

OTHER PUBLICATIONS

Written Opinion issued in Intl. Appln. No. PCT/JP2017/013934 dated Jun. 13, 2017. English translation provided.
International Preliminary Report on Patentability issued in Intl. Appln. No. PCT/JP2017/013934 dated Nov. 1, 2018. English translation provided.
Extended European Search Report issued in European Appln. No. 17785773.7 dated Oct. 29, 2019.
Office Action issued in European Appln. No. 17785773.7 dated Jun. 29, 2020.

* cited by examiner

MUSICAL INSTRUMENT

CROSS REFERENCE TO RELATED APPLICATION

The present application is a continuation application of International Application No. PCT/JP2017/13934, filed on Apr. 3, 2017, which claims priority to Japanese Patent Application No. 2016-085055, filed on Apr. 21, 2016. The contents of these applications are incorporated herein by in their entirety.

BACKGROUND

The present disclosure relates to a musical instrument capable of generating electronic sound.

Acoustic musical instruments conventionally include an adjusting mechanism having vibration characteristics corresponding to a sound generating member, in order to adjust pitches and provide preferable tone color and feeling in playing. There are known adjusting mechanisms for electronic musical instruments for which the physical adjusting mechanisms for acoustic musical instruments are used without any changes or which have a configuration copying that of the physical adjusting mechanisms for acoustic musical instruments. In many electronic musical instruments, however, a result of adjustment of the adjusting mechanism has no effects on sound generated by a sound source, making the adjusting mechanism merely a decoration. One example of such a configuration is a configuration in which a cymbal stand is provided with a bolt that adjusts the inclination of an upper one of high hat cymbals to change a degree of contact of a lower cymbal with the upper cymbal. In the case where this configuration is applied to electronic cymbals, however, no effects are directly given to sound generated by the sound source even when the inclination of the cymbal is changed.

Some acoustic musical instruments include a mount mechanism not only for the adjustment but also for adjusting sound generation of a sound generating member, for example. One example of such a configuration is a configuration in which a striking surface of an acoustic drum is put on and fastened to a hoop with a tuning bolt that is also used to adjust the tension of the striking surface to change a strike feeling and sound.

SUMMARY

One example of electronic musical instruments is a percussion instrument with a mesh head tensioned on a shell in imitation of acoustic snare drums. In this musical instrument, rotation of a tuning key changes the tension of the head, which affects a strike feeling. However, a pitch of sound is not changed.

Patent Document 1 discloses an electronic cymbal with an adjusting nut that is adjusted to adjust variation of a predetermined value indicating a closed state. However, even if the adjusting nut is adjusted, this adjustment does not reflect on musical-sound effects such as a tone color. Accordingly, there is a possibility of achieving rich musical sound as electronic musical sound in the case where a relationship between an adjusting operation and generated musical sound is brought close to that of acoustic musical instruments.

Accordingly, an aspect of the disclosure relates to a musical instrument enabling physical adjustment to reflect on musical sound generated by a musical-sound generator.

In one aspect of the disclosure, a musical instrument comprises: a vibrating member configured to be vibrated by a playing operation; an adjusting mechanism configured to perform physical adjustment to change a vibration manner of the vibrating member in playing; a detector configured to detect an adjustment state of the adjusting mechanism; a musical-sound generator configured to generate musical sound based on the playing operation; and a controller configured to control a manner of generation of the musical sound by the musical-sound generator, based on the adjustment state detected by the detector.

BRIEF DESCRIPTION OF THE DRAWINGS

The objects, features, advantages, and technical and industrial significance of the present disclosure will be better understood by reading the following detailed description of the embodiments, when considered in connection with the accompanying drawings, in which.

EMBODIMENTS

Hereinafter, there will be described embodiments by reference to the drawings.

First Embodiment

Figure 1:
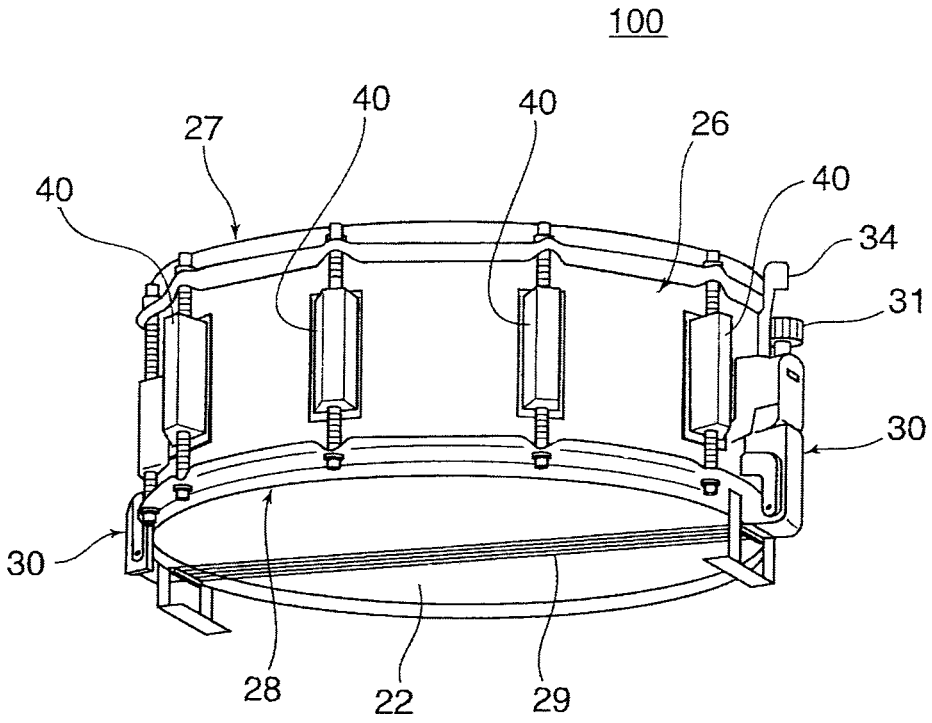
FIG. 1 is a perspective view of a musical instrument according to a first embodiment.
Figure 2:
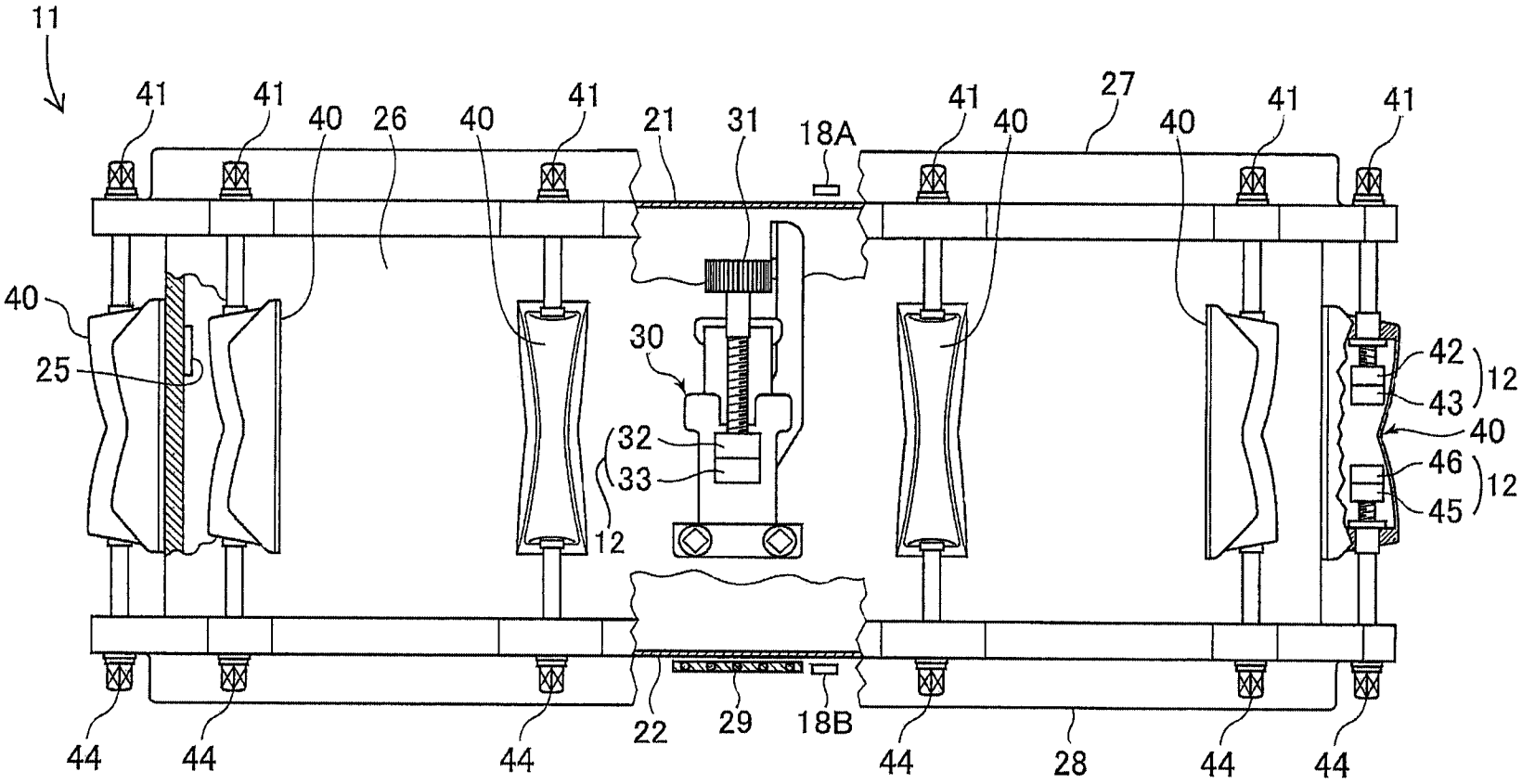
FIG. 2 is a side view of the percussion instrument.

FIG. 1 is a perspective view of a musical instrument according to a first embodiment. The musical instrument according to the present embodiment is a percussion instrument 100 in the form of a snare drum. FIG. 2 is a side view of the percussion instrument 100, illustrating a portion thereof cut out in cross section. This percussion instrument 100 is an acoustic musical instrument and usable as an electronic musical instrument configured to generate electronic sound by detecting playing operations.

The percussion instrument 100 includes a shell 26 (as one example of a supporter) shaped like a cylinder. A batter head 21 is disposed in an opening formed in one of opposite ends of the shell 26, and a resonance head 22 is disposed in an opening formed in the other. In the following description, the up and down direction will be used for the percussion instrument 100 with respect to its orientation in which the batter head 21 is located on an upper side. The resonance head 22 and the batter head 21 are held symmetrically in the up and down direction in the same manner. A plurality of one-piece-type lugs 40 are secured to an outer circumferential surface of the shell 26 so as to be spaced uniformly. An annular hoop 27 is disposed in the opening of the shell 26 in which the batter head 21 is disposed, and an annular hoop 28 is disposed in the opening of the shell 26 in which the resonance head 22 is disposed.

A microphone 18A is provided near an upper surface of the batter head 21. A microphone 18B is provided near a lower surface of the resonance head 22. Each of the microphones 18A, 18B obtains sound produced from a corresponding one of the batter head 21 and the resonance head 22. A vibration detecting sensor 25 is provided on an inner circumferential surface of the shell 26. While a piezoelectric element may be used as the vibration detecting sensor 25, for example, any element may be used as the vibration detecting sensor 25 as long as the element can detect vibration. The vibration detecting sensor 25 is principally used for detecting vibration of the shell 26 to detect a strike with a stick, such as a strike on the head and a strike on a rim.

As indicated by the cross section of a portion of the lug 40 in FIG. 2, tuning bolts 41, 44 (each as one example of an adjustment operating member) are engaged with the lug 40 for each lag 40. When the tuning bolt 41 is rotated and thereby moved in the axial direction, the tension of the batter head 21 can be adjusted. When the tuning bolt 44 is rotated and thereby moved in the axial direction, the tension of the resonance head 22 can be adjusted. Thus, the adjustment of an amount of tightening of each of the tuning bolts 41, 44 engaged with the lugs 40 can adjust vibration manners of the batter head 21 and the resonance head 22, i.e., the tension of each of the batter head 21 and the resonance head 22. This adjustment changes the tone color of acoustic sound generated by a strike and also changes a feeling of the strike. When lock nuts engaged with the respective tuning bolts 41, 44 are tightened, positions at which the respective tuning bolts 41, 44 are tightened are fixed. As described above, the batter head 21 and the resonance head 22 are supported on the shell 26 in a state in which the batter head 21 and the resonance head 22 are tensioned. The amount of tightening of each of the tuning bolts 41, 44 is changed in this state, and thereby the tension of each of the batter head 21 and the resonance head 22 is adjusted.

For each of the lugs 40, a cushion 42 and a sensor 43 are provided on a lower end of the tuning bolt 41, and a cushion 45 and a sensor 46 are provided on an upper end of the tuning bolt 44. The sensors 43, 46 are secured to the lug 40. Each of the sensors 43, 46 is a pressure-sensitive sensor, for example. Signals output from the sensors 43, 46 are supplied to a CPU 5 (FIG. 4) which will be described below. When the tuning bolt 41 is tightened, a pressing force applied to the sensor 43 via the cushion 42 increases, whereby the sensor 43 obtains an output related to the amount of tightening of the tuning bolt 41 (the position of the tuning bolt 41). Likewise, the sensor 46 obtains an output related to the amount of tightening of the tuning bolt 44 (the position of the tuning bolt 44). Thus, the degree of the tension of each of the heads 21, 22 can be detected based on the outputs of the sensors 43, 46. A mechanism for detecting an amount of the adjustment of the tension of each of the heads 21, 22 using the tuning bolts is installed on one or more lugs 40 and may be installed on all the lugs 40.

Snare wires 29 are normally provided on a front side (lower side) of the resonance head 22. The snare wires 29 are snares for drums (snappy). A pair of snare wire mounts 30, 30 are secured to the outer circumferential surface of the shell 26 respectively at positions that are symmetric in the diameter direction of the shell 26. These mounts 30, 30 are constituted by a fixed strainer and a movable strainer and disposed respectively at positions avoiding the lugs 40. The mount 30 includes a lever 34. Opposite ends of each of the snare wires 29 are fastened to the respective mounts 30, 30. The snare wires 29 are tensioned so as to be selectively movable toward and away from the lower surface of the resonance head 22 by an operation of the lever 34.

As indicated by the cross section of a portion of one of the mounts 30 in FIG. 2, a tuning bolt 31 (as one example of an adjustment operating member) is engaged with the one of the mounts 30. When the tuning bolt 31 is rotated and thereby moved in the axial direction, an amount of tightening of the tuning bolt 31 can be adjusted to adjust the tension of the snare wires 29. As a result, the tone color of acoustic sound generated by a strike is changed. That is, the snare wires 29 are supported in a state in which the shell 26 is tensioned, and the tension of the snare wires 29 is adjusted by changing the amount of tightening of the tuning bolt 31 in this state. A cushion 32 and a sensor 33 are provided at a lower end of the tuning bolt 31. The sensor 33 is secured to the mount 30. The sensor 33 is a pressure-sensitive sensor, for example. Signals output from the sensor 33 are supplied to the CPU 5 which will be described below. When the tuning bolt 31 is tightened, a pressing force applied to the sensor 33 via the cushion 32 increases, whereby the sensor 33 obtains an output related to the amount of tightening of the tuning bolt 31 (the position of the tuning bolt 31). Thus, the degree of the tension of the snare wires 29 can be detected based on the output of the sensor 33. It is noted that the mounts 30, 30 are provided in a pair but may be provided independently.

Figure 3A:
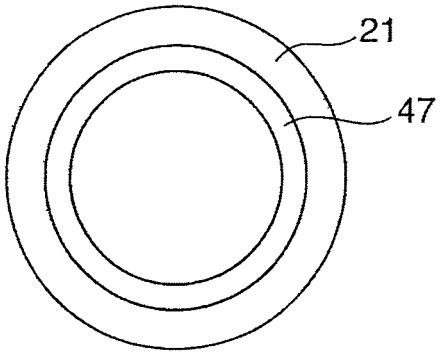
FIGS. 3A and 3B are schematic plan views of a batter head.
Figure 3B:
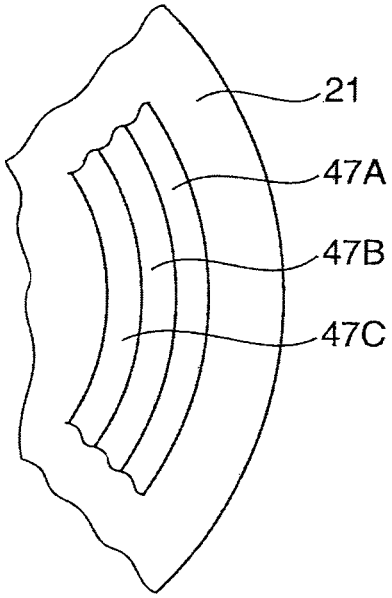
Figure 3C:
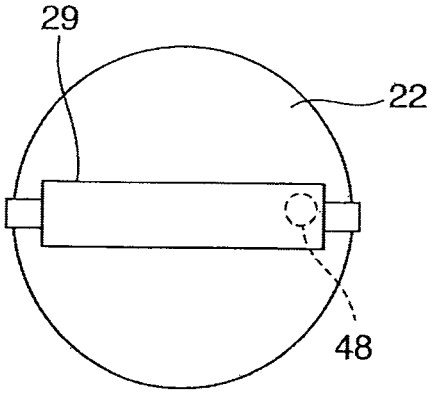
FIG. 3C is a schematic bottom view of a resonance head.

FIG. 3A is a schematic plan view of the batter head 21. FIG. 3B is a schematic plan view of a portion of the batter head 21. FIG. 3C is a schematic bottom view of the resonance head 22. As illustrated in FIG. 3A, a sensor 47 is provided near an outer edge of the batter head 21 so as to extend in the circumferential direction. The sensor 47 is configured to sense a mute formed of, e.g., a gel and provided on the upper surface of the batter head 21 for muting. The sensor 47 is a pressure-sensitive sensor, for example. The sensor 47 detects placement of the mute and an amount of the placed mute. Alternatively, as illustrated in FIG. 3B, a plurality of the sensors 47 (47A, 47B, 47C) may be provided concentrically to detect the position of the mute in the radial direction.

As illustrated in FIG. 3C, a sensor 48 is provided on the lower surface of the resonance head 22 at a position opposed to the snare wires 29. This sensor 48 is configured to detect whether the snare wires 29 are brought into contact with the lower surface of the resonance head 22 by an operation of the lever 34. The sensor 48 is a pressure-sensitive sensor, for example.

Figure 4:
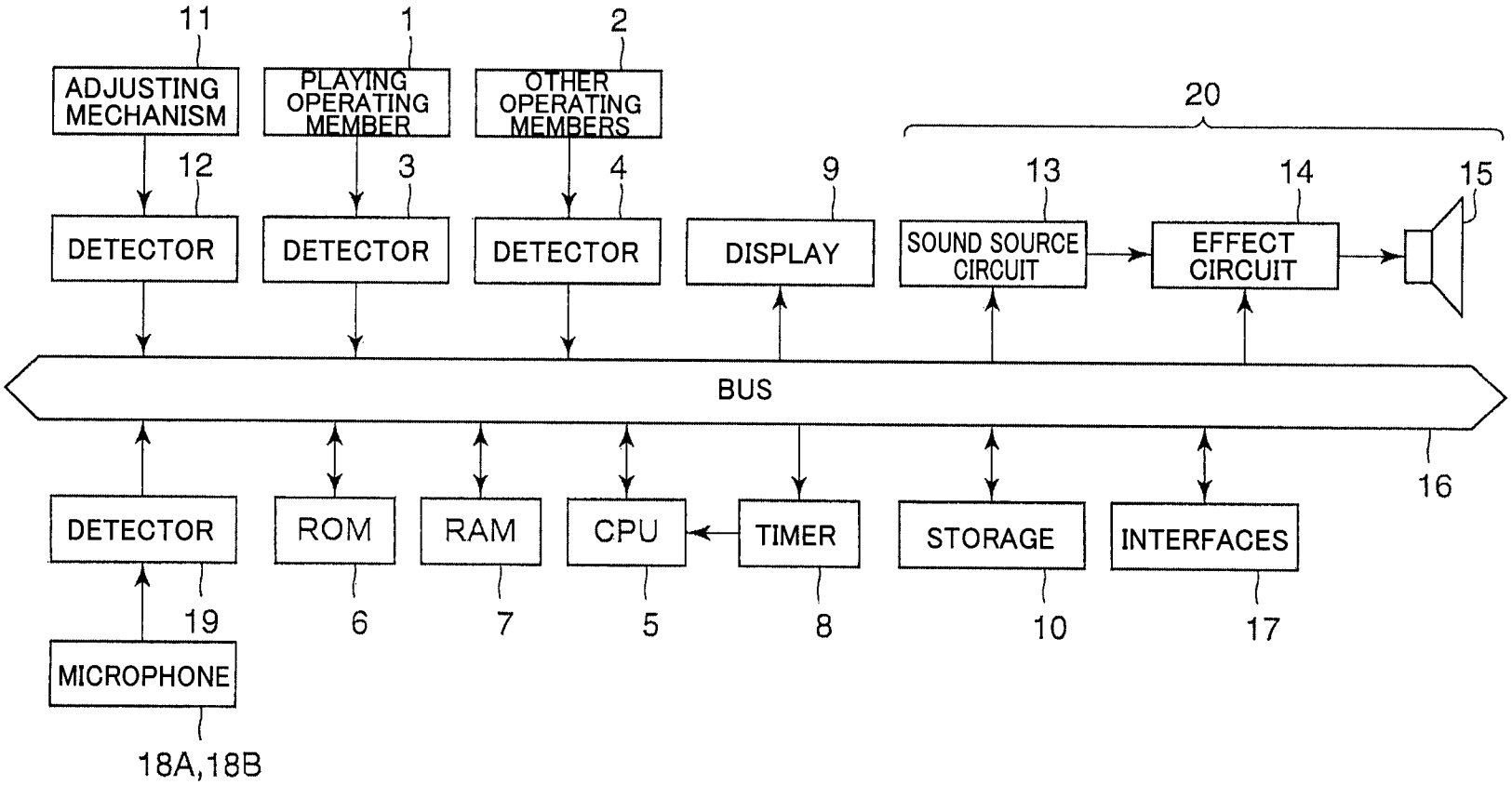
FIG. 4 is a block diagram indicating an overall configuration of the percussion instrument.

FIG. 4 is a block diagram indicating an overall configuration of the percussion instrument 100. In the percussion instrument 100, detectors 3, 4, 12, 19, a ROM 6, a RAM 7, a timer 8, a display 9, a storage 10, various kinds of I/Fs (interfaces) 17, a sound source circuit 13, and an effect circuit 14 are connected to the CPU 5 via a bus 16. Each of the detectors 3, 4, 12, 19 includes an A/D converter. Playing operating members 1 include the heads 21, 22, and the detector 3 includes the vibration detecting sensor 25. Other operating members 2 include setting operating members, not illustrated, for inputting various kinds of information, for example. An adjusting mechanism 11 includes the lugs 40 and the mounts 30, and the detector 12 includes the sensors 43, 46, 33, 47, 48. Thus, the detector 12 detects an adjustment state of each of the lugs 40 and the mounts 30. Sound obtained by microphones 18 (18A, 18B) is converted to a digital signal by the detector 19 and supplied to the CPU 5.

The display 9 displays various kinds of information. The timer 8 is connected to the CPU 5. A sound system 15 is connected to the sound source circuit 13 via the effect circuit 14. The sound source circuit 13, the effect circuit 14, and the sound system 15 constitute a musical-sound generator 20.

The various kinds of I/Fs 17 include a MIDI (Musical Instrument Digital Interface) I/F and a communication I/F. The CPU 5 executes overall control for the present musical instrument. The ROM 6 stores control programs to be executed by the CPU 5 and various kinds of table data, for example. The RAM 7 temporarily stores various kinds of input information, various kinds of flags, buffer data, and results of calculation, for example. The storage 10 is a non-volatile memory, for example, and stores the above-described control programs, various kinds of musical-sound data, and the various kinds of data, for example. The sound source circuit 13 converts data, such as playing data input from the playing operating members 1 and preset playing data, to musical-sound signals. The effect circuit 14 applies various kinds of effects to the musical-sound signals input from the sound source circuit 13. The sound system 15 including a DAC (Digital-to-Analog Converter), an amplifier, and a speaker converts the musical-sound signals and the like input from the effect circuit 14, to musical sound.

Musical-sound control is executed in a manner described below. The CPU 5 first inputs a control signal into the sound source circuit 13 based on a digital signal supplied from the detector 19 and the detector 3. The sound source circuit 13 creates a musical-sound signal related to the control signal at the timing of the input of the control signal. Thus, the signal output from the microphones 18 and the vibration detecting sensor 25 is used as a trigger for generating sound. It is noted that using all of these output signals is not essential, and only one of the output signals may be used. The effect circuit 14 applies effects to the musical-sound signal, and the sound system 15 amplifies and converts the musical-sound signal to musical sound to generate striking sound.

Here, the CPU 5 controls a manner of generation of the musical sound by the musical-sound generator 20 (the sound source circuit 13, the effect circuit 14, and the sound system 15), based on an adjustment state of the adjusting mechanism 11 (a result of detection of the detector 12). For example, the effects to be applied by the effect circuit 14 are changed depending upon the adjustment state of the adjusting mechanism 11, independently of conventional designation performed by a user. There are various examples of such control, but the present disclosure is not limited thereto. There will be described some specific examples.

For example, the CPU 5 controls the pitch of sound to be generated, the decay time of the sound volume (decay), the tone color, and so on in accordance with the adjustment state of each of the lugs 40 (the tightening state of each of the tuning bolts 41, 44) detected by the sensors 43, 46. For example, the pitch is made higher as the tightening gets stronger. It is noted that the musical instrument may be configured such that a plurality of items of waveform data for generating percussion-instrument sound are selected in advance, and the CPU 5 selects the waveform data to be used, in accordance with the adjustment state of each of the lugs 40. It is noted that, in the case where both of the tightening states of the tuning bolts 41, 44 are used, an average of the tightening states may be used, or predetermined weights may be assigned to the states. While a plurality of the tuning bolts 41 and a plurality of the tuning bolts 44 are provided, all or some of the tightening states of the respective tuning bolts 41, 44 may be used for the musical-sound control, and any of the tightening states may be used.

The CPU 5 controls the tone color and so on of sound to be generated, based on the adjustment state of each of the mounts 30 (the tightening state of the tuning bolt 31) detected by the sensor 33. For example, the CPU 5 sets musical-sound-control parameters (e.g., gain and a cutoff frequency for a filter), based on an output of the sensor 33. It is noted that the CPU 5 may select waveform data to be used, based on the adjustment state of each of the mounts 30. The output of the sensor 33 may reflect on the musical-sound control only in the case where the sensor 48 has detected that the snare wires 29 are in contact with the resonance head 22.

The CPU 5 also controls the tone color and so on of sound to be generated, based on an adjustment state of vibration of the batter head 21 (a state of the placed mute) which is detected by the sensor 47. For example, the CPU 5 sets the musical-sound-control parameters (e.g., the gain and the cutoff frequency for the filter), based on at least one of the presence or absence of the placed mute(s), an amount of the placed mute(s), and a position or positions of the placed mute(s).

In the present embodiment, the manner of generation of musical sound by the musical-sound generator 20 is controlled based on the adjustment state of the adjusting mechanism 11 which is detected by the detector 12. This configuration enables physical adjustment in the percussion instrument 100 to reflect on musical sound to be generated from the musical-sound generator 20. Accordingly, such changes in the effects that are obtained by the acoustic musical instruments can be applied to electronic musical sound by adjustment normally performed for common acoustic musical instruments, making it possible to generate rich musical sound.

Each of the heads 21, 22 as one example of a vibrating member that is vibrated by a playing operation is a sound generator, enabling the physical adjustment to reflect on musical sound that is a mixture of acoustic sound and electronic musical sound. In particular, since the tone color of sound generated by the heads 21, 22 is directly changed by the physical adjustment, the adjustment increases the variety of changes in the tone color, for example. Richer musical sound control can be executed by controlling the manner of generation of musical sound based on both of the tightening states of the tuning bolt 41 and the tuning bolt 44. The tuning bolts 41, 44 adjust the amount of tightening to adjust the tension of the batter head 21 and the resonance head 22, thereby adjusting vibration states of the batter head 21 and the resonance head 22. In the present embodiment, since the adjustment state of the adjusting mechanism 11 is detected by the sensors 43, 46 based on the amount of tightening of each of the tuning bolts 41, 44, it is possible to detect the adjustment state of the adjusting mechanism 11 with a simple configuration. Likewise, the tuning bolt 31 adjusts the amount of tightening to adjust the tension of the snare wires 29. In the present embodiment, since the sensor 33 detects the adjustment state of the adjusting mechanism 11 based on the amount of tightening of the tuning bolt 31, it is possible to detect the adjustment state of the adjusting mechanism 11 with a simple configuration.

It is noted that musical sound may be controlled based on an output of at least one of the sensors 43, 46, 33, 47, 48. Only a sensor or sensors, of which output is to be used, may be provided.

Second Embodiment

Figure 5A:
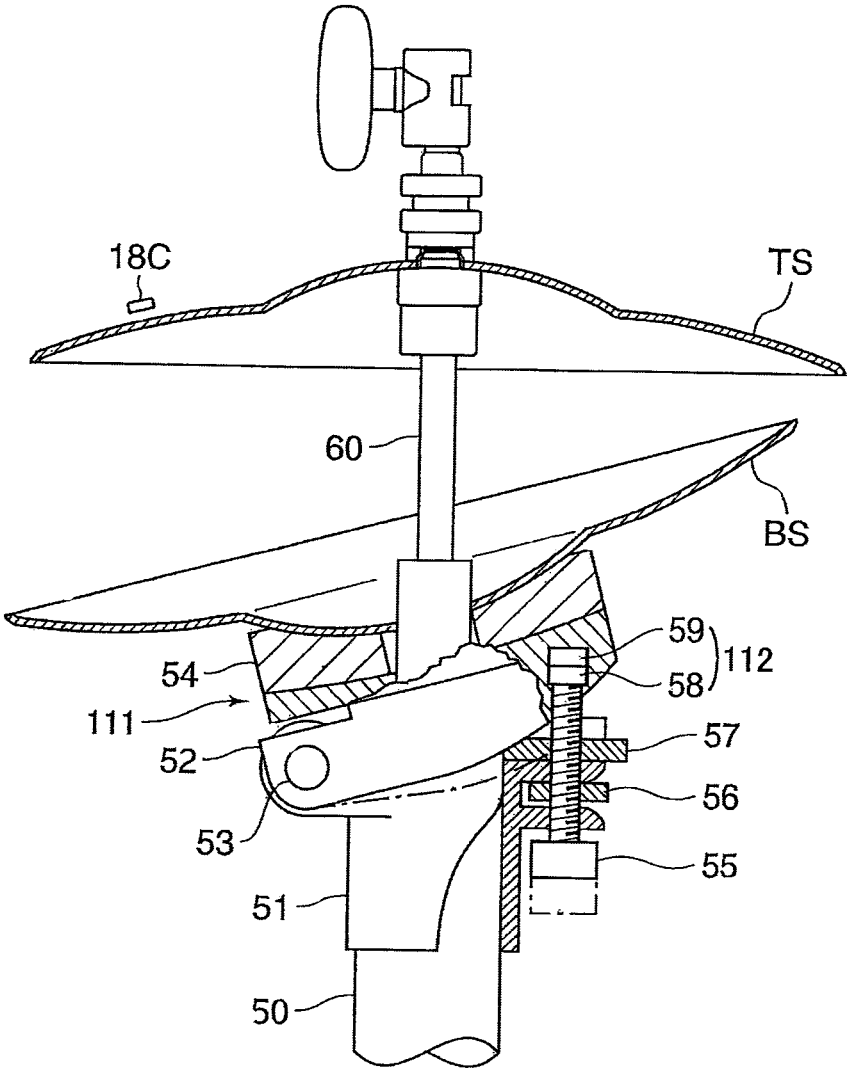
FIG. 5A is a side view of a main portion of high-hat cymbals according to a second embodiment.

While the musical instrument is a snare drum in the first embodiment, the musical instrument is high-hat cymbals in a second embodiment. FIG. 5A is a side view of a main portion of the high-hat cymbals.

The high-hat cymbals (hereinafter referred to as "1111 cymbals") include a top cymbal TS and a bottom cymbal BS. The top cymbal TS is moved upward and downward in conjunction with a rod 60 moved upward and downward by an operation of a pedal, not illustrated. A microphone 18C is provided near an upper surface of the top cymbal TS. It is noted that a microphone may be provided near a lower surface of the bottom cymbal BS. Musical sound is generated in response to a detection signal output from the microphone 18C as a trigger. Thus, the HH cymbals are also an acoustic musical instrument and usable as an electronic musical instrument configured to generate electronic sound by detecting playing operations.

An adjusting mechanism 111 for adjusting an inclination angle of the bottom cymbal BS is provided on the bottom cymbal BS to prevent close contact and separation between the top cymbal TS and the bottom cymbal BS at their respective overall circumferences when the top cymbal TS contacts or is separated from the bottom cymbal BS. In the adjusting mechanism 111, a cylindrical retainer 51 is secured to an upper end of a pipe 50 (as one example of the supporter). A receiving pan 52 having a planar plate shape is supported on the retainer 51 so as to be pivotable about a shaft 53. An absorber 54 for absorbing vibration of the bottom cymbal BS is disposed on an upper surface of the receiving pan 52. A nut 56 is mounted on one of opposite end portions of the retainer 51, and the shaft 53 is mounted on the other. An adjusting screw 55 (as one example of the adjustment operating member) is engaged with the nut 56 in a state in which a distal end of the adjusting screw 55 faces upward. A cushion 58 and a sensor 59 are disposed at the upper end of the adjusting screw 55. The cushion 58 and the sensor 59 are secured to the receiving pan 52. The distal end of the adjusting screw 55 is in contact with a lower surface of the receiving pan 52. When the adjusting screw 55 is rotated and moved downward, the receiving pan 52 pivots about the shaft 53 to adjust the inclination angle of the bottom cymbal BS. When a lock nut 57 engaged with the adjusting screw 55 is tightened on the retainer 51, the inclination angle of the bottom cymbal BS is fixed.

The configurations of the cushion 58 and the sensor 59 are the same as those of the cushion 42 and the sensor 43 (FIG. 2). In the present embodiment, a detector 112 includes the sensor 59. The adjustment state of the adjusting mechanism 111 which is detected by the sensor 59 is a position of the bottom cymbal BS, specifically, an inclination angle thereof. When the position of the bottom cymbal BS is changed in accordance with the tightening state of the adjusting screw 55, however, a manner of contact and separation between the top cymbal TS and the bottom cymbal BS each as the vibrating member changes. Accordingly, the adjustment state to be detected by the sensor 59 includes states of the top cymbal TS and the bottom cymbal BS.

In the present embodiment, the CPU 5 also controls the manner of generation of musical sound by the musical-sound generator 20 (the sound source circuit 13, the effect circuit 14, and the sound system 15), based on the adjustment state of the adjusting mechanism 111 (a result of detection of the detector 112). For example, the CPU 5 controls the pitch of sound to be generated, the decay time of the sound volume (decay), the tone color, and so on, based on the inclination state of the bottom cymbal BS (the tightening state of the adjusting screw 55) which is detected by the sensor 59. For example, the decay time is made longer as the tightening gets stronger. It is noted that the musical-sound-control parameters (e.g., the gain and the cutoff frequency for the filter) may be set based on the tightening state. The CPU 5 may select waveform data to be used, based on the tightening state of the adjusting screw 55. This configuration makes it possible to adjust what is called buff sound and a way of muffling of sound. It is noted that more real changes can be achieved by adjusting the tone color and extension of sustain in splash playing, based on the tightening state. It is further noted that the adjusting mechanism 11 and the detector 12 in FIG. 4 are replaced respectively with the adjusting mechanism 111 and the detector 112 in the present embodiment.

In the present embodiment, the same effects as achieved in the first embodiment can be achieved in a respect in which physical adjustment in the musical instrument reflects on musical sound to be generated from the musical-sound generator 20.

Figure 5B:
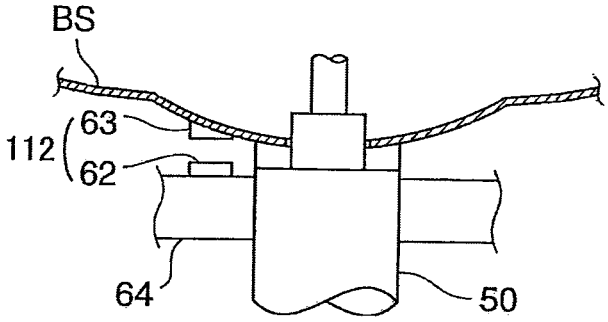
FIG. 5B is a side view of a modification.

The configuration for detecting the inclination of the bottom cymbal BS is not limited to one illustrated in FIG. 5A. For example, as illustrated in FIG. 5B as a modification, a pair of distance detecting mechanisms 62, 63 may be provided respectively on a stay 64 secured to the pipe 50 and a back surface of the bottom cymbal BS to detect the inclination state of the bottom cymbal BS from a change in distance between the distance detecting mechanisms 62, 63. While the configurations of the distance detecting mechanisms 62, 63 are not limited, triangulation with laser light may be used, for example.

Figure 6A:
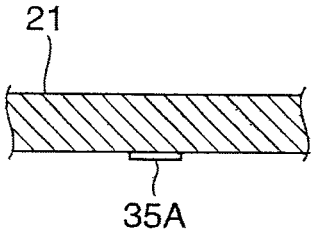
FIGS. 6A through 6C are schematic views of a musical instrument according to a modification.
Figure 6B:
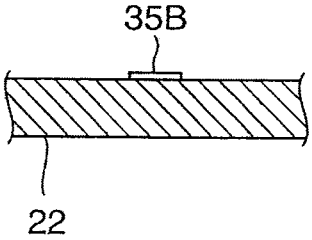

It is noted that each of the musical instruments in the present embodiments may be configured as a pure electronic musical instrument without generation of acoustic sound. In this case, the heads 21, 22 are formed of an elastic material such as rubber in the first embodiment. As illustrated in FIGS. 6A and 6B as a modification, a vibration detecting sensor 35A is provided on a lower surface of the batter head 21, with a reinforcing plate, not illustrated, interposed therebetween. A vibration detecting sensor 35B is provided on an upper surface of the resonance head 22, with a reinforcing plate, not illustrated, interposed therebetween. The vibration detecting sensors 35A, 35B respectively detect vibration of the batter head 21 and vibration of the resonance head 22. At least one of signals output from the respective vibration detecting sensors 25 (FIG. 2), 35A, 35B is used for a trigger for generating sound. Focusing on the heads 21, 22, since the vibrating member is a member to be played, even in a case where the present disclosure is applied to an electronic musical instrument as in the present modification, it is possible to achieve changes in musical sound which are similar to those in a case where physical adjustment is performed for acoustic musical instruments.

Figure 6C:
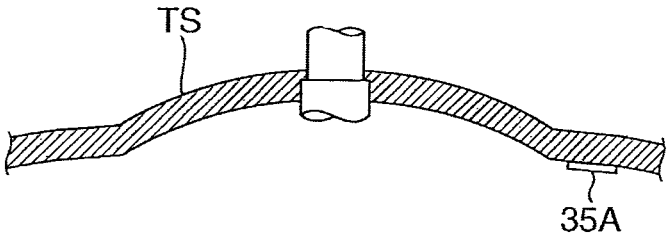

In the second embodiment, as illustrated in FIG. 6C as a modification, the vibration detecting sensor 35A configured to detect vibration of the top cymbal TS is provided on a back surface of the top cymbal TS formed of an elastic material such as rubber. Musical sound is generated in response to a detection signal output from the vibration detecting sensor 35A as a trigger. The vibration detecting sensors 35A, 35B are included in the detector 3.

In the above-described embodiments and modifications, the mechanism for detecting the adjustment state of the adjusting mechanism 11 is not limited to the pressure-sensitive sensor and may be a mechanism configured to directly detect an amount of movement of a movable component of the adjusting mechanism 11. For example, the mechanism for detecting the adjustment state of the adjusting mechanism 11 may be a mechanism using a rotary encoder to detect an amount of rotation of a rotatable component of the adjusting mechanism 11.

In the above-described embodiments and modifications, the vibrating member to be vibrated by a playing operation is not limited to the examples described above. It is not essential that the vibrating member is a sound generator or a component to be played. The adjusting mechanism 11 only needs to have a function of changing a vibration manner of the vibrating member in playing with physical adjustment as a result and is not limited to the adjusting mechanism described above. Accordingly, the vibrating member is not limited to a component that is directly adjusted and may be a component that is indirectly adjusted to change its state. Examples of the state of the vibrating member which is changed by adjustment of the adjusting mechanism 11 include not only the tension and the tightening state but also a position and an orientation.

It is noted that the present disclosure is applicable to drums other than the snare drum such as toms and bass drums and also applicable not only to drums and cymbals but also to various kinds of percussion instruments.

While the embodiments have been described above, it is to be understood that the present disclosure is not limited to the illustrated embodiments, but may be embodied with various modifications, without departing from the spirit and scope of the present disclosure. Portions of the above-described embodiments may be combined with each other as needed.

What is claimed is:

1. A musical instrument comprising:

a supporting body;

a vibrating member supported by the supporting body and configured to be vibrated by a playing operation;

an adjusting mechanism configured to perform physical adjustment to change a vibration manner of the vibrating member, wherein the adjusting mechanism includes an adjustment operating member that is changeable in position to adjust a degree of tension of the vibrating member and change the vibration manner of the vibrating member;

a detector configured to detect an adjustment state of the adjusting mechanism;

a musical-sound generator configured to generate musical sound based on the playing operation; and a controller configured to control a manner of generation of the musical sound by the musical-sound generator, based on the adjustment state detected by the detector.

2. The musical instrument according to claim 1, wherein the vibrating member is a sound generator.

3. The musical instrument according to claim 2, wherein the adjusting mechanism is configured to perform physical adjustment to change a tone color of sound generated by the sound generator.

4. The musical instrument according to claim 1, wherein the vibrating member is a member to be played.

5. The musical instrument according to claim 1, wherein the adjusting mechanism is configured to change a state of the vibrating member.

6. The musical instrument according to claim 1, wherein the detector is configured to detect the position of the adjustment operating member.

7. The musical instrument according to claim 1, wherein:

a plurality of ones of the vibrating member and a plurality of ones of the adjusting mechanism are provided in correspondence with each other, and the controller is configured to control the manner of generation of the musical sound by the musical-sound generator, based on adjustment states of the plurality of the ones of the adjusting mechanisms detected by the detector.

8. A musical instrument comprising:

a supporting body;

a vibrating member supported by the supporting body and configured to be vibrated by a playing operation;

an adjusting mechanism configured to perform physical adjustment to change a vibration manner of the vibrating member, wherein the adjusting mechanism includes an adjustment operating member that is changeable in position to adjust an inclination state of the vibrating member with respect to the supporting body and change the vibration manner of the vibrating member;

a detector configured to detect an adjustment state of the adjusting mechanism;

a musical-sound generator configured to generate musical sound based on the playing operation; and a controller configured to control a manner of generation of the musical sound by the musical-sound generator, based on the adjustment state detected by the detector.

* * * * *